US005457979A

United States Patent [19]

Castellani

[11] Patent Number: 5,457,979

[45] Date of Patent: Oct. 17, 1995

[54] UNIVERSAL DEMOUNTABLE ROLLING MILL STAND

[75] Inventor: Federico Castellani, Tarcento, Italy

[73] Assignee: S.I.M.A.C. S.P.A., Tarcento, Italy

[21] Appl. No.: 919,540

[22] Filed: Jul. 24, 1992

[30] Foreign Application Priority Data

Jul. 25, 1991 [IT] Italy ..... UD91A0118

[51] Int. Cl.[6] ..... B21B 13/08

[52] U.S. Cl. ..... 72/225; 72/238; 72/246

[58] Field of Search ..... 72/238, 225, 224, 72/246

[56] References Cited

U.S. PATENT DOCUMENTS

| | | | |
|---|---|---|---|
| 3,948,072 | 4/1976 | Aramaki | 72/225 |
| 4,557,130 | 12/1985 | Bond | 72/237 |
| 4,706,484 | 11/1987 | Dittmar et al. | 72/238 |
| 4,715,206 | 12/1987 | Forni | 72/225 |
| 4,753,097 | 6/1988 | Buchheit | 72/225 |
| 4,932,233 | 6/1990 | Bogendorfer | 72/225 |
| 4,969,347 | 11/1990 | Matsuo et al. | 72/248 |
| 4,974,438 | 12/1990 | Stubbins | 72/238 |

FOREIGN PATENT DOCUMENTS

| | | | |
|---|---|---|---|
| 0065935 | 12/1982 | European Pat. Off. | 72/238 |
| 0291719 | 11/1988 | European Pat. Off. . | |
| 0298318 | 1/1989 | European Pat. Off. . | |
| 1072577 | 6/1960 | Germany . | |

*Primary Examiner*—Lowell A. Larson
*Assistant Examiner*—Thomas C. Schoeffler
*Attorney, Agent, or Firm*—Harrison & Egbert

[57] ABSTRACT

A universal rolling mill stand of a demountable type having two pairs of adjustable rollers. One of the adjustable rollers has a pair of horizontal rollers and another has a pair of vertical rollers. The horizontal rollers and the vertical rollers are mounted demountably from a support base by a horizontal ring stand which is demountable from the base. A pair of lateral vertical side support structures slide apart in opposite directions from the pair of horizontal rollers such that an interior ring of a support roller bearing is retained on the rollers.

6 Claims, 5 Drawing Sheets

UNIVERSAL DEMOUNTABLE ROLLING MILL STAND

TECHNICAL FIELD

The object of this invention is a universal demountable rolling mill stand.

BACKGROUND ART

Demountable and adjustable rolling mill stands which can be installed vertically or horizontally and universal (vertical and horizontal) rolling mill stands are well known.

These rolling mill stands are at times difficult to disassemble for maintenance and to interchange the rollers.

Other aspects regard the gasket support systems of the rollers which are cumbersome or limit the diameter of the respective necks of the rollers.

The universal rolling mill stands, due to their structural complexity, can't easily pretension the force of clamping between the rollers in such a way that up to a certain limit they don't move apart (and beyond this limit they separate) to avoid deformation of the bar in rolling.

A further problem to overcome is that when the rollers separate-they must be able to freely oscillate in order to avoid deformations of the respective support surfaces particularly in the coupling of respective spacers of pretensioning means and in order not to load in an improper way the bearings.

If we want to realize such a structure we are obliged to make it very complex and difficult to be completely demounted.

SUMMARY OF THIS INVENTION

These and other problems are solved with this invention as claimed by means of a universal rolling mill stand of a demountable type that involves two adjustable roller devices (adjustable separately or together), respectively, one with a pair of horizontal rollers and the other with a pair of vertical rollers, characterized in that the entire rolling mill group, involving a pair of horizontal rollers and a pair of vertical rollers, is mounted demountably from a respective support base by a horizontal support stand ring in turn demountable from the base.

With this solution, we obtain the advantages of:

making easily demountable the entire machine for maintenance, allowing a fast change of rollers both those horizontal and vertical, with a simple structure, robust, reliable and cheap without influencing the respective operative efficiency and able to bear a very high load capacity; reducing the size without influencing its use and universality.

The rolling mill group is demountable in: P1 two demountable lateral vertical side support structures, sliding apart in opposite directions from the respective pair of horizontal rollers, so allowing the rollers to be extracted easily;

two groups of opposite vertical rollers each supporting a vertical roller by a vertically removable roller support, said roller support being demountably mounted in a horizontal ring, in an adjustable way, in order to form a vertical rolling mill group.

In this way we obtain a complete demountablity of the rolling mill stand ensemble.

The rolling mill group is more particularly demountable in:

two lateral vertical side support structures, sliding apart in opposite directions from the respective pair of horizontal rollers, leaving in the necks of the rollers the interior ring of the respective roller bearings, wherein the two lateral vertical side support structures are divided into upper and lower portions and endowed with two pairs of pretensioning tie rods to clamp said upper and lower portions of side structures together with the respective rollers, allowing the ensemble to be placed into a base, in condition for the desired pretensioning.

two groups of opposite vertical rollers each supporting a vertical roll, said two groups of opposite vertical rollers being demountably mounted in a horizontal ring in an adjustable way, in order to form a vertical rolling mill group.

In this way we obtain a complete and functional demountability. The horizontal ring includes two bridges with a horizontal pair of parallel tie rods with a median spacer that forms a ring in the center of which has to be inserted vertically the two groups of vertical rollers.

With this solution we integrate effectively the guide system of the rolled section with the vertical rolling mill system.

The two bridges of the horizontal ring dispose in an intermediate position, tie rod strut means for the respective vertical rollers.

In this way we can carry out a very effective and precise regulation.

The horizontal ring is demountable from the base by means of four rotatable engageable bolts on guide supports of the vertical tie rods, which forms the base of the guide for the respective supports of said vertical rollers.

In this way we obtain a support system, guides and self-centering of the entire rolling mill group for the respective assembly.

Advantageously the axial alignment is made by means of regulating worm screws by only one traversal regulating axis mounted on one of the two sides.

This solution improves the technique of disassembly.

Also advantageously the size variation of the rolling inlet (the distance between the rollers) is made by means of a rotation system of eccentric compasses by only one transversal regulation axis able to be disjointed between the two side structures.

With this solution we further simplify the total structure of the stand and the fine aligning adjusting.

Also advantageously the structure is prearranged for the removal of the pair of orthogonal vertical rollers making therefore possible the obtainment of an horizontal stand.

These and other advantages appear in the following description and drawings which details are not to be considered limitative.

BRIEF DESCRIPTION OF THE DRAWINGS

In particular as claimed, note that, FIGS. 4 and 5 represent the first step of the demounting process, raising the rolling mill group GOV (the respective vertical roller devices GV slide vertically from the respective ring GA) from the base BA and ring GA whereas FIG. 6 represents the second step of demounting the rolling group GOV (the respective side structures GL slide apart horizontally from the pair of horizontal rollers 1, and the respective vertical roller devices GV slide apart from said side structures GL).

DETAILED DESCRIPTION OF THE INVENTION

Figure 1:
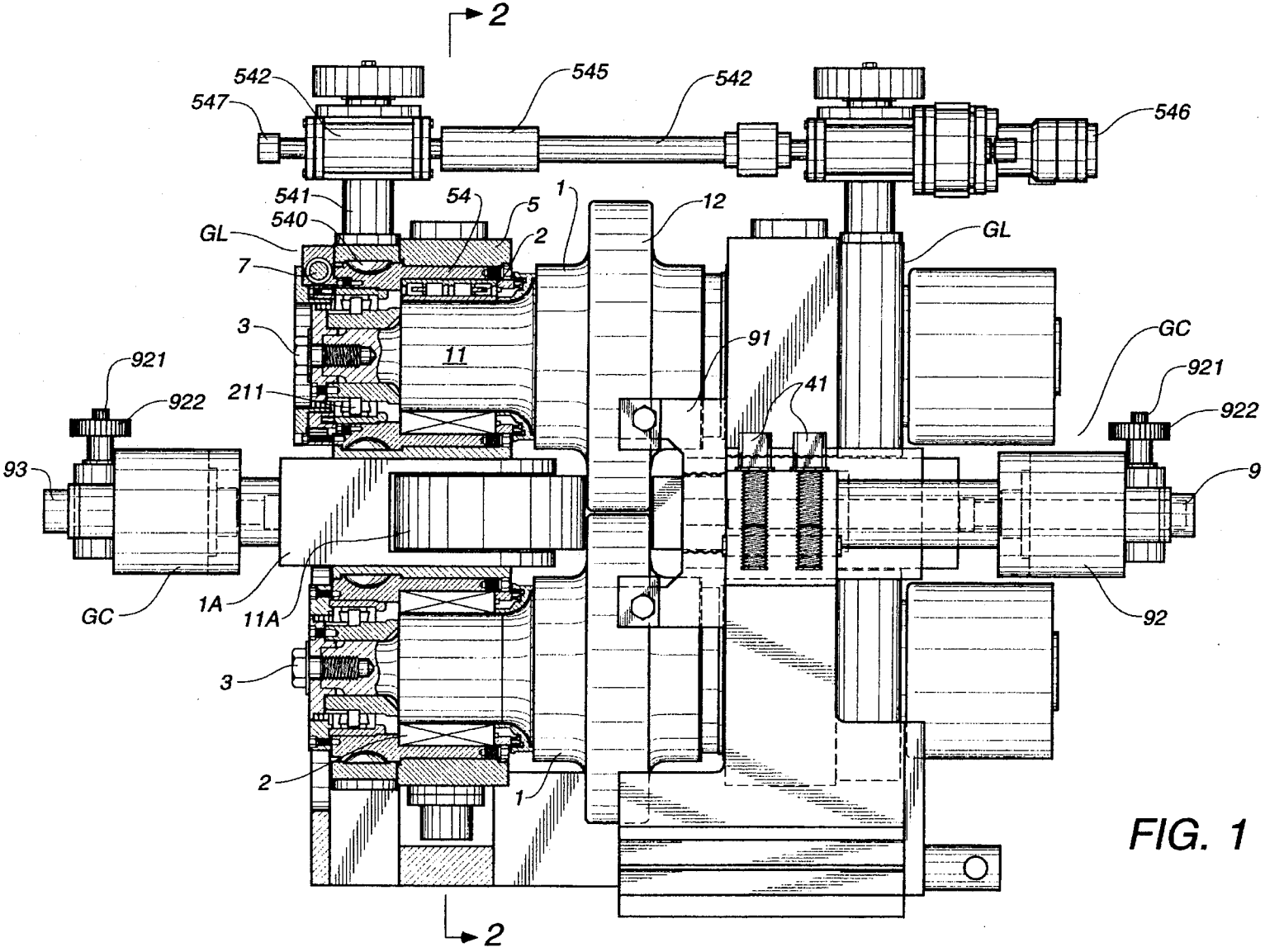
FIG. 1 represents a frontal view of a partial section of the rolling mill stand.
Figure 2:
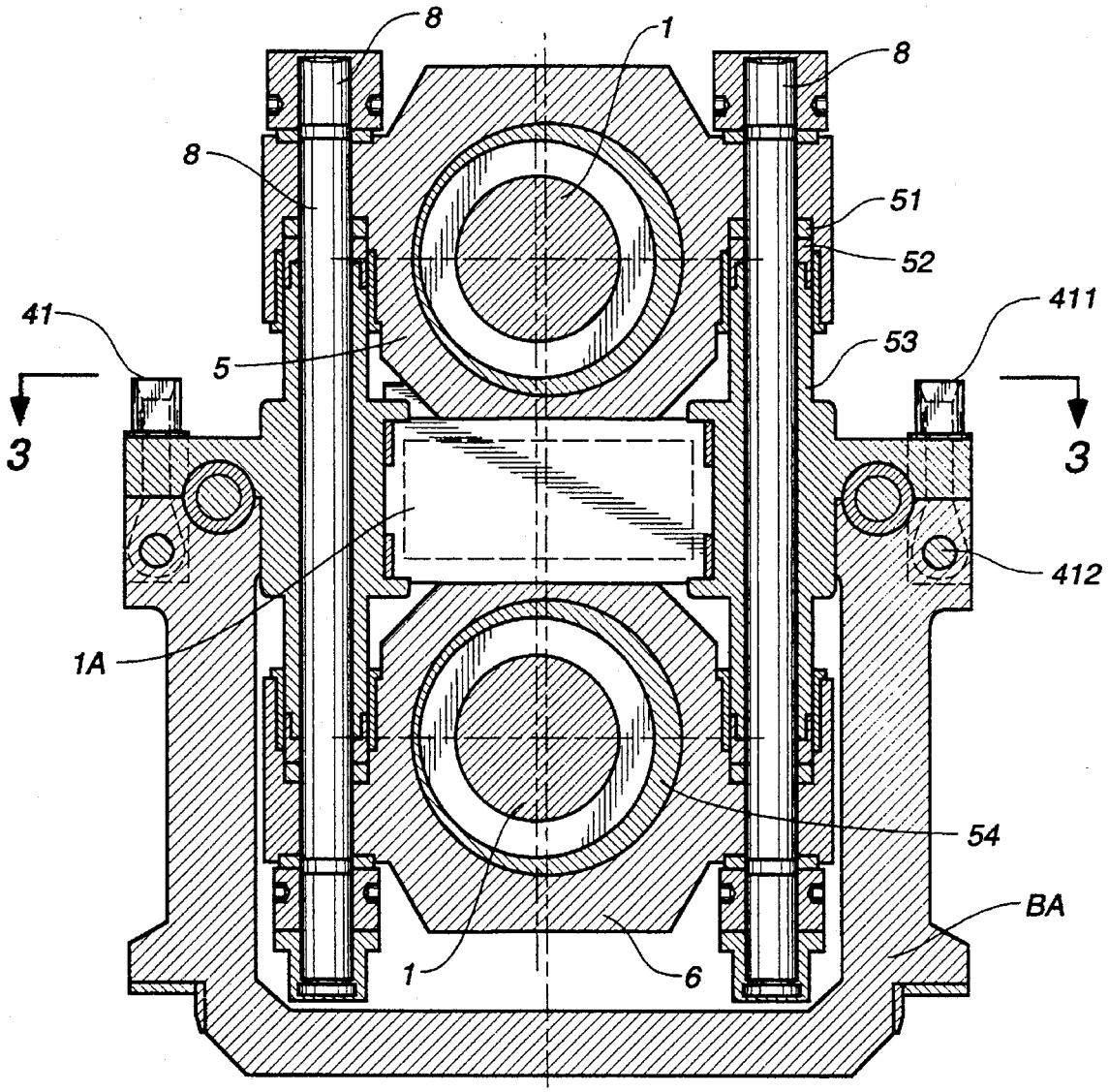
FIG. 2 represents a sectional view of the rolling mill stand according to plan A—A of FIG. 1.

Referring to the Figures, the rolling mill stand is of a demountable type with a pair of horizontal rollers (1) and a pair of vertical ones (1A) adjustable in their rolling axle separately or together, and includes:

a support base (4-BA);

a pair of rollers (1) with necks that mount the respective roller bearings (2);

two side structures of lateral support rollers (GL) sliding in an opposite direction from the horizontal rollers (1), leaving in the necks (11) of the horizontal rollers (1) the respective interior ring (21) of the roller support bearings (2);

two pairs of pretensioning tie rods (8) for clamping the upper (5) and lower (6) portions of the side structures (GL) together with the respective rollers (1-GO,1A-GV), allowing the ensemble to be placed into a base, in condition for the desired pretensioning.

The axial alignment is made by means of regulating worm screws (7).

The variation of the rolling inlet position as a single movement of both axles of the rollers is made by means of a rotation system of eccentric compasses (54) by two vertical regulation axes (541) mounted on the respective side structures (GL) connected by only one transversal horizontal axis (542,545).

The rotation is made by the engaging a respective endless screw portion of the regulation axis (51) with a toothed sector (540) of the respective compass (5). This eccentric rotational engagement is incorporated in the independent support gaskets (5,6) each one forming said upper and lower portions of the side structures (GL).

Also advantageously the structure is prearranged for the removal of the pair of vertical orthogonal rollers (1A-GV) making therefore possible the obtainment of an horizontal rolling stand.

These vertical rollers include the rollers (11A) with a support for the rollers (12A) that is mounted independently in one horizontal ring (GA) that is fixable to the base (BA) by means of rotatable bolts (41) that clamp a central portion with a vertical ring (91) for the insertion of the rolled sections. (IL).

The structure includes respective horizontal tie rods (923) on clamping blocks (81) inside which passes the vertical guide tie rods (8) that act as a slide for the supports (12A) of the vertical rollers (11A).

Figure 3:
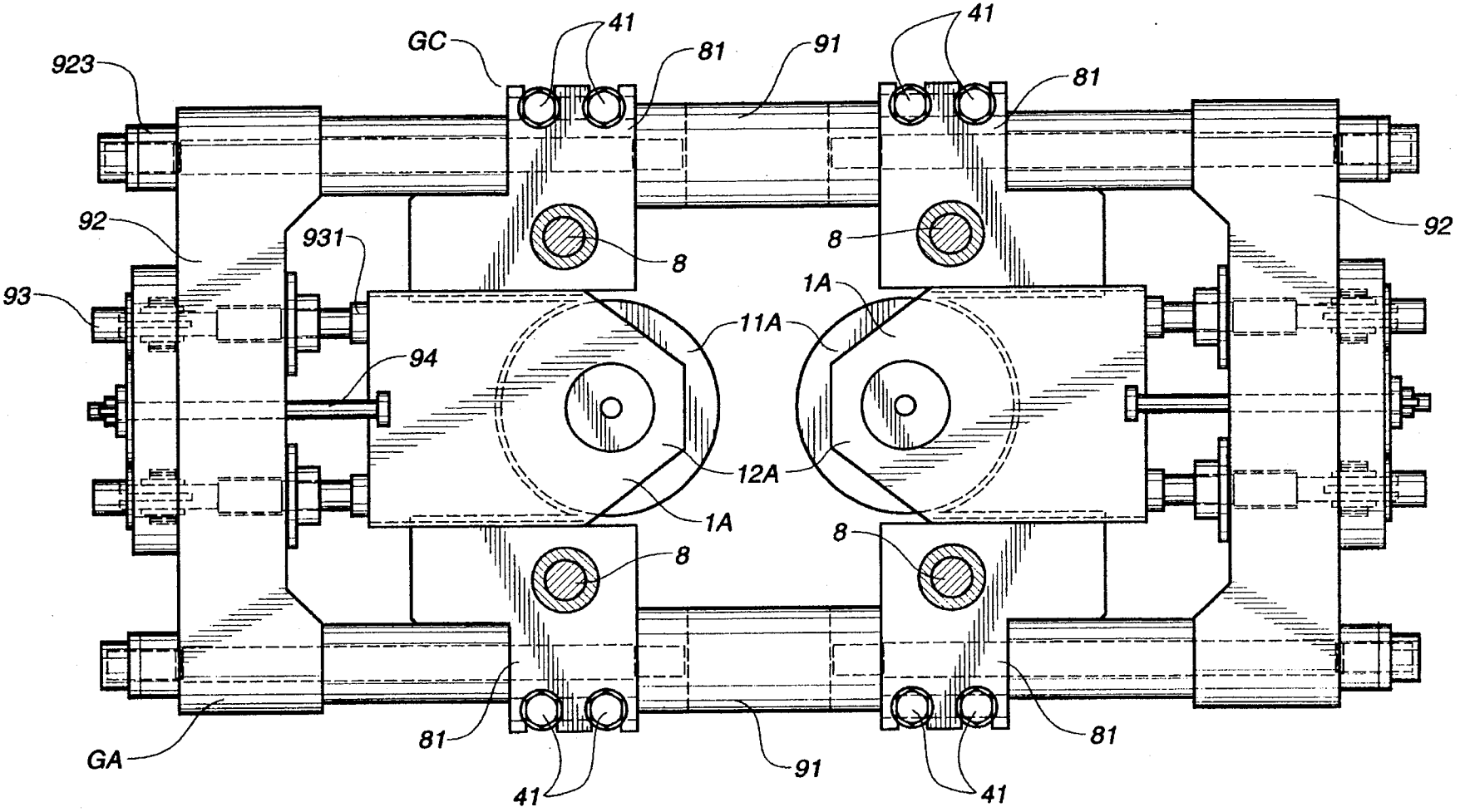
FIG. 3 represents a sectional view of the rolling mill stand seen from above according to plan C—C of FIG. 2.
Figure 4:
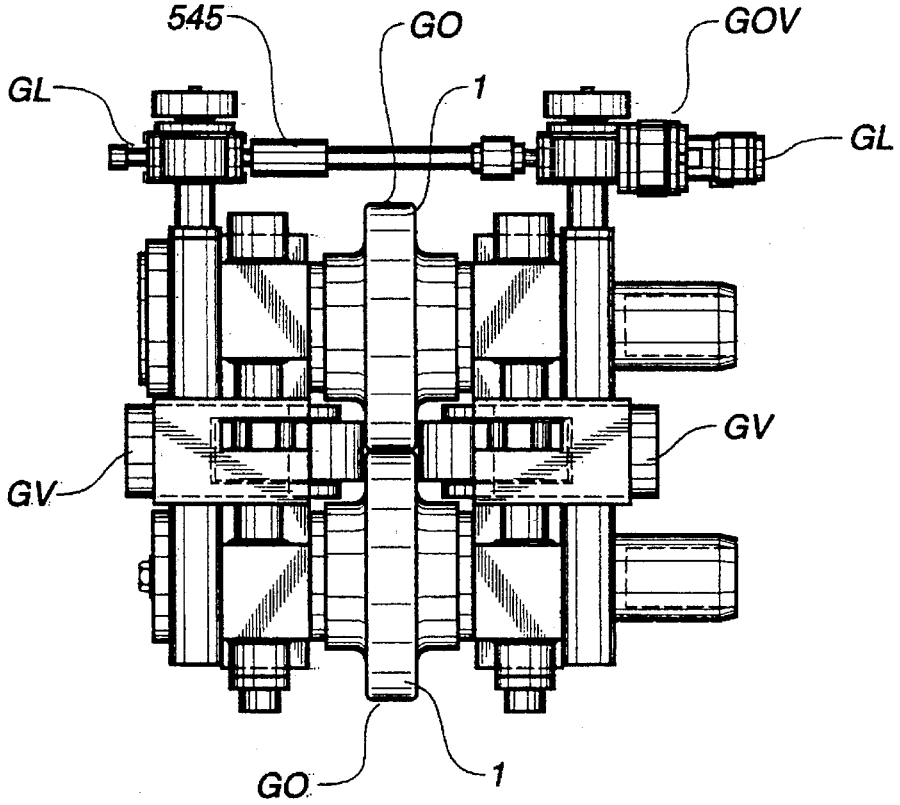
FIG. 4 represents a frontal view of the rolling mill group demounted from the base.
Figure 5:
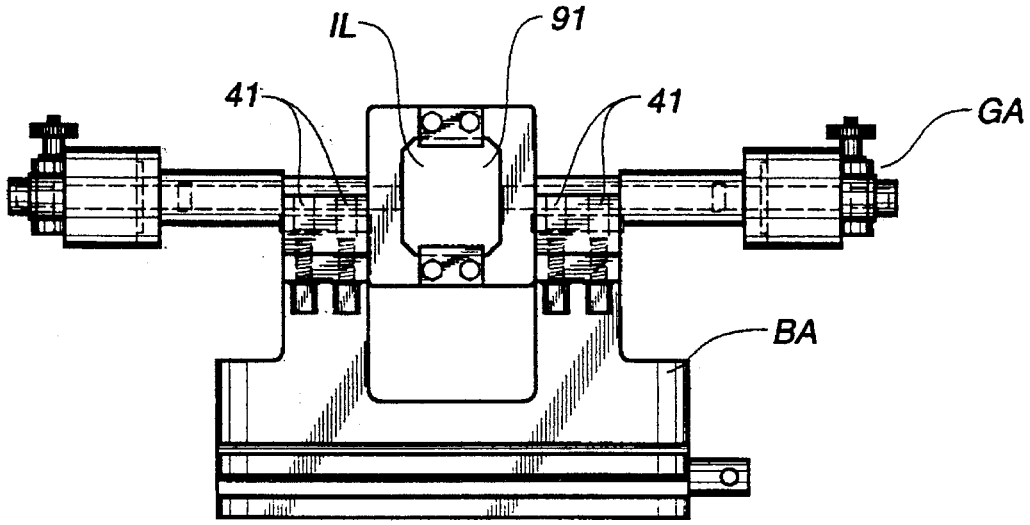
FIG. 5 represents a frontal view of the base of the rolling mill stand with the respective support ring and self-centering rolling mill group.
Figure 6:
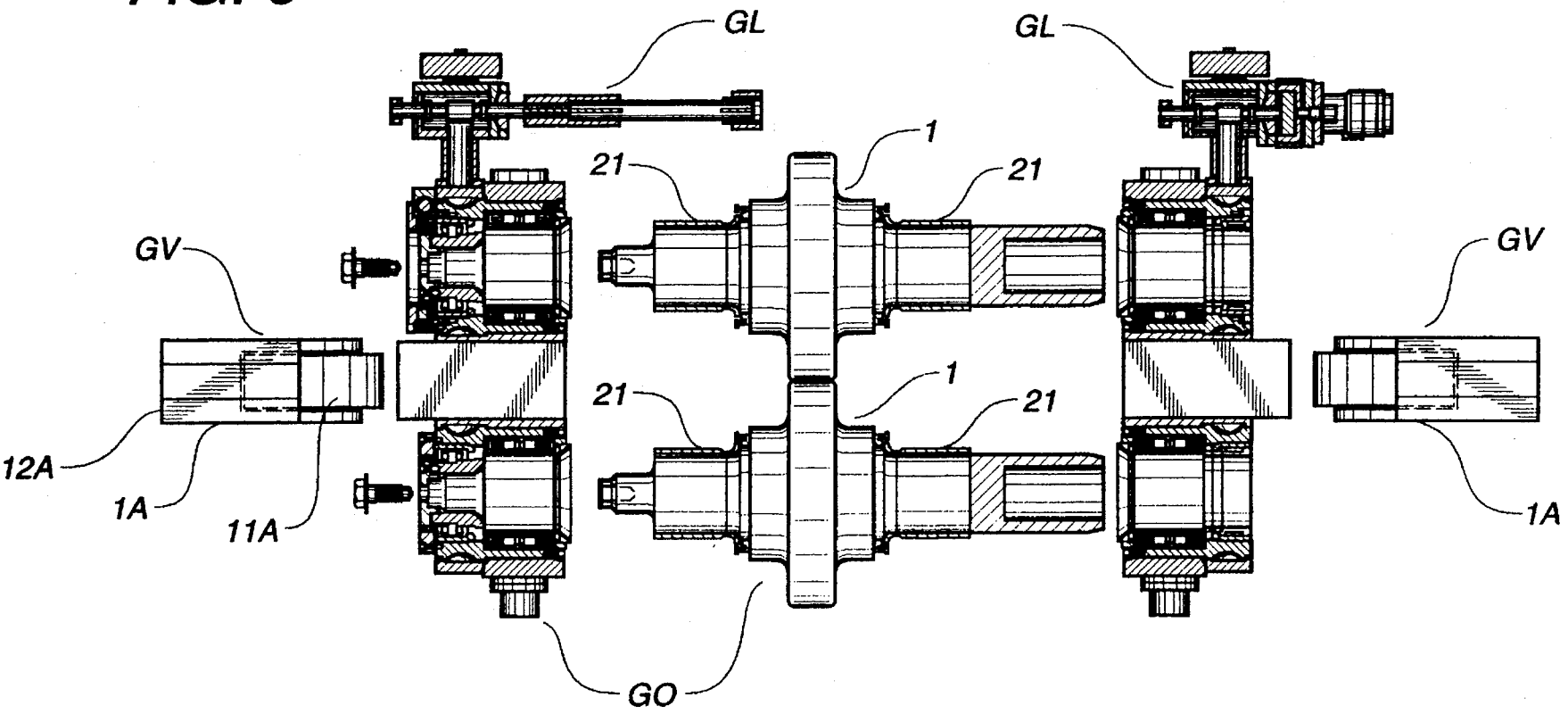
FIG. 6 represents an enlarged view of the demounting of the rolling mill group.

Two opposite bridges (92) are clamped by the horizontal tie rods (923) and these bridges bear center tie rods (94) and strut screws (93-931) for fine regulation of the rolling inlet size of the vertical rollers (1A FIG. 3)

The pretensioning tie rods (8) operate on the respective gaskets (5,6) by means of central spacers (53) and spacer ends (51–52) that couple with spherical surface in order to not impede the eventual oscillations of the rollers (1) due to their flexion.

The disassembly can be done as noted in the Figures from 4 to 6 in which the rolling mill group GOV is detached from the base BA and from the horizontal ring GA.

In turn the rolling mill group GOV is disassembled in two side structures GL that slide in opposite directions, from the horizontal rollers 1, and in an horizontal ring (GA) from which two groups of vertical rollers (for vertical rolling) GV can be removed vertically, without removing the respective two opposite bridges (92).

I claim:

1. A universal rolling mill stand of a demountable type comprising two adjustable roller devices, one of said adjustable roller devices having a pair of horizontal rollers and another of said adjustable roller devices having a pair of vertical rollers, said pair of horizontal rollers and said pair of vertical rollers mounted demountably from a respective support base by a horizontal ring stand support which is demountable from said support base, said rolling mill stand further comprising:

two demountable lateral vertical side support structures sliding apart in opposite directions from said pair of horizontal rollers leaving in a neck of said horizontal rollers an interior ring of a support roller bearing;

a vertically removable roller support supporting said pair of vertical rollers, one of said pair of vertical rollers opposing another of said pair of vertical rollers, said roller support being adjustable by a regulation means.

2. The stand according to claim 1, said horizontal ring stand support having two opposite bridges that adjustably support the vertical rollers by a center tie rod and a strut screw.

3. The stand according to claim 1, said horizontal ring stand support is demountable from said base by means of four rotatable bolt series engagable on support guides of vertical tie rods, said support guides forming a guide base for the supports of said vertical rolls.

4. The stand according to claim 1, each of said adjustable roller devices having an inlet, said inlet having a size adjustable by means of a rotation system of eccentric compasses by two vertical regulation axes mounted on said side support structures, said vertical regulation axes are connected by one transversal disjointable axis for allowing regulation of only one of said vertical regulation axes.

5. A universal rolling mill stand of a demountable type comprising two adjustable roller devices, one of said adjustable roller devices having a pair of horizontal rollers and another of said adjustable roller devices having a pair of vertical rollers, said pair of horizontal rollers and said pair of vertical rollers mounted demountably from a respective support base by a horizontal ring stand support which is demountable from said support base, said rolling mill stand further comprising:

two demountable lateral vertical side support structures slidable apart in opposite directions from said pair of horizontal rollers so as to leave in a neck of said horizontal rollers an interior ring of a support roller bearing, wherein said two lateral vertical side support structures are divided into an upper portion and a lower portion, said side support structures having two pairs of pretensioning tie rods and for clamping said upper portion and said lower portion of said side support structures together with said rollers; and a vertically removable roller support supporting said vertical rollers in opposing relationship, said roller support being adjustable by a regulation means.

6. The stand according to claim 5, said pretensioning tie rods operate on said upper portion and said lower portion of said side support structures by means of center spacers and spacer ends.

* * * * *